US006284370B1

(12) United States Patent
Fujimoto et al.

(10) Patent No.: US 6,284,370 B1
(45) Date of Patent: Sep. 4, 2001

(54) POLYESTER FIBER WITH EXCELLENT PROCESSABILITY AND PROCESS FOR PRODUCING THE SAME

(75) Inventors: Katsuhiro Fujimoto; Jinichiro Kato, both of Nobeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/555,118

(22) PCT Filed: Nov. 26, 1998

(86) PCT No.: PCT/JP98/05328

§ 371 Date: May 25, 2000

§ 102(e) Date: May 25, 2000

(87) PCT Pub. No.: WO99/27168

PCT Pub. Date: Jun. 3, 1999

(30) Foreign Application Priority Data

Nov. 26, 1997 (JP) ..... 9-339502
Jan. 29, 1998 (JP) ..... 10-30391
Apr. 23, 1998 (JP) ..... 10-128118

(51) Int. Cl.[7] ..... D01F 6/00; D01F 6/92; D01F 6/62

(52) U.S. Cl. ..... 428/364; 428/395

(58) Field of Search ..... 428/364, 395; 57/245

(56) References Cited

U.S. PATENT DOCUMENTS

| | | | | |
|---|---|---|---|---|
| 3,584,108 | | 6/1971 | Nelson et al. | 264/289 |
| 3,681,188 | | 8/1972 | Harris et al. | 161/173 |
| 3,984,600 | * | 10/1976 | Kywase et al. | 428/364 |
| 4,454,196 | * | 6/1984 | Iohara et al. | 428/364 |
| 4,475,330 | * | 10/1984 | Kimura et al. | 57/245 |

FOREIGN PATENT DOCUMENTS

| | | |
|---|---|---|
| 0 547 533 A1 | 6/1993 | (EP) . |
| 0 745 711 A1 | 12/1996 | (EP) . |
| 0 949 363 A2 | 10/1999 | (EP) . |

(List continued on next page.)

OTHER PUBLICATIONS

The Mechanical Properties and Structure of Poly(m–methylene Terephthalate) Fibers, Journal of Polymer Science, Polymer Physics Edition, vol. 14, pp. 263–274 (1976).

(List continued on next page.)

*Primary Examiner*—N. Edwards
(74) *Attorney, Agent, or Firm*—Finnegan, Henderson, Farabow, Garrett & Dunner, L.L.P.

(57) ABSTRACT

A polyester fiber comprising 90% or more by weight of a poly(trimethylene terephthalate), and showing a peak value of a thermal stress of 0.1 to 0.35 g/d, a boil-off shrinkage of 5 to 16%, a tenacity of 3 g/d or more, an elongation of 20 to 60%, a relationship between an elastic modulus Q (g/d) and an elastic recovery R (%) satisfying the formula (1), and a peak temperature of a loss tangent of 90 to 120° C.:

$$0.18 \leqq Q/R \leqq 0.45 \quad (1)$$

The polyester fiber of the present invention is a poly(trimethylene terephthalate) fiber which has an elongation, a thermal stress and a boil-off shrinkage in appropriate ranges, and the woven or knitted fabric prepared therefrom shows inhibition of an excessive thermal shrinkage during processing and manifests a low elastic modulus and a soft hand touch. Accordingly, the polyester fiber of the present invention is suitable for use in innerwear, outerwear, sportswear, legwear, lining cloths, swimwear and the like. In addition, the polyester fiber can be stably manufactured in high productivity by a process in which spinning and drawing are consecutively conducted to prevent the undrawn yarn from aging.

12 Claims, 3 Drawing Sheets

FOREIGN PATENT DOCUMENTS

| | | | |
|---|---|---|---|
| 52-5320 | | 1/1977 | (JP) . |
| 52-8123 | | 1/1977 | (JP) . |
| 52-8124 | | 1/1977 | (JP) . |
| 58-31114 | | 2/1983 | (JP) . |
| 58-104216 | | 6/1983 | (JP) . |
| 59-211620 | | 11/1984 | (JP) . |
| 5-262862 | | 12/1993 | (JP) . |
| 0 8173244 A | | 7/1996 | (JP) . |
| 9-3724 | | 1/1997 | (JP) . |
| 411100768A | * | 4/1999 | (JP) . |
| 411107036A | * | 4/1999 | (JP) . |
| 411107038A | * | 4/1999 | (JP) . |
| 411172526A | * | 6/1999 | (JP) . |
| 411302919 A | * | 11/1999 | (JP) . |
| 96/00808 | | 1/1996 | (WO) . |

OTHER PUBLICATIONS

Texturing of textile filament yarns based on polytrimethylene terephthalate, Chemical Fibers International, vol. 47, Feb. 1997.

Mechanical properties of fibers made of polytrimethylene terephthalate, Chemical Fibers International, vol. 45, Apr. 1995.

* cited by examiner

POLYESTER FIBER WITH EXCELLENT PROCESSABILITY AND PROCESS FOR PRODUCING THE SAME

DESCRIPTION

1. Technical Field

The present invention relates to a poly(trimethylene terephthalate) fiber. The present invention relates, in more detail, to a poly(trimethylene terephthalate) fiber which has a suitable thermal stress and a suitable boil-off shrinkage and which gives a fabric, when woven or knitted, showing less stiffness caused by excessive shrinkage, and manifesting softness and the excellent color developing property expected from the low elastic modulus characteristic of the fiber. The present invention particularly relates to a poly (trimethyleneterephthalate) fiber suitable for use in innerwear, outerwear, sportswear, lining cloths, legwear, swimwear and the like.

2. Background Art

A fiber prepared from a poly(trimethylene terephthalate) (hereinafter abbreviated to PTT) which is obtained by polycondensation of terephthalic acid or a lower alcohol ester of terephthalic acid represented by dimethyl terephthalate with trimethylene glycol (1,3-propanediol) is an important polymer having properties similar to those of a polyamide such as a low elastic modulus (softness), an excellent elastic recovery and an easily dyable property and has performances similar to those of a polyethylene terephthalate (hereinafter abbreviated to PET) such as resistance to light and heat setting and also has dimension stability and low water absorption. The fiber can be applied to BCF carpet, brushes, tennis request's gut, etc., by making use of the properties and performance of the fiber (U.S. Pat. Nos. 3584108 and 3681188, J. Polymer Science; Polymer Physics Edition 14, 263–274 (1976), Chemical Fibers International 45, P 110–111 (April, 1995) and Japanese Unexamined Patent Publication (Kokai) Nos. 9-3724, 8-173244 and 5-262862).

That is, use of a PTT gives a fiber having a low elastic modulus (softness), an excellent elastic recovery and an easily dyable property which are the features of a polyamide fiber, and shows an improvement in resistance to light, a heat setting property and the like, which are poor in a polyamide fiber. There is therefore the possibility that a PTT fiber is capable of surpassing a polyamide fiber when used in a clothing material.

Japanese Unexamined Patent Publication (Kokai) Nos. 52-5320 (A), 52-8123 (B), 52-8124 (C) and 58-104216 (D), etc., disclose PTT fibers for clothing applications. The PTT fibers are obtained by, for example, a process comprising melt spinning at a rate of 300 to 3,500 m/min to give an undrawn yarn, and hot drawing the undrawn yarn, in one or more steps (multiple steps), while the undrawn yarn is being heated up to a temperature greater than its glass transition temperature, namely, a temperature 35° C. or greater. According to studies by the present inventors, the fiber obtained by such a process shows a high thermal stress which is a parameter of a shrinking force when heat is imparted thereto, and a boil-off shrinkage of some magnitude which is a parameter of a shrinking amount at the time when heat is imparted thereto; therefore, a woven or knitted fabric prepared therefrom excessively shrinks in the processing steps at room temperature or above such as scouring, presetting, caustic-reduction, dyeing and final setting, does not exhibit a softness which is expected from the low elastic modulus characteristic to the PTT fiber, and tends to become a stiff and hard fabric. When weaving or knitting is conducted while the density of weaving or knitting is kept low, with the shrinkage taken into consideration in advance, in order to prevent the fabric from becoming stiff and hard, a softness of the fabric can be attained to a certain extent. However, the procedure has serious disadvantages as explained below. A structural shift tends to take place in the woven or knitted fabric during processing steps and, as a result stabilized production of a woven or knitted fabric becomes difficult. Moreover, such a shift takes place during the use of the fabric. Furthermore, these known PTT fibers are more excellent in a color developing property than PET fibers. However, the PTT fibers have the disadvantage that they are difficult to dye with a deep color and a black color, that is, they have a problem of having a poor color developing property as a yarn dyeable under normal pressure, although there arises no problem about dyeing with a pale color under normal pressure.

Furthermore, each of the technologies disclosed in the patent publications listed above adopts a process wherein a melt spun, undrawn yarn is wound and then drawn. PTT differs from PET in that PTT has a glass transition temperature of 30 to 50° C. which is close to room temperature; therefore, crystallization of PTT proceeds fairly rapidly even at temperature close to room temperature compared with PET. That is, even when an undrawn PET yarn having a low crystallinity is stored at temperature close to room temperature, the yarn shows no change in the fine structure and properties. In contrast, a PTT yarn shows formation of microcrystals, shrinkage of the yarn caused by molecular orientation relaxation, and the like. When microcrystals are formed, formation of fluff, yarn breakage and nonuniform physical properties of the drawn yarn are likely to be seen. Moreover, when the undrawn yarn shrinks, the yarn layers in the inner layers of the undrawn yarn cheese are firmly tightened. As a result, the unwinding tension becomes high, and a fluctuation in the tension increases at the same time. Therefore, uneven drawing, formation of fluff and yarn breakage often take place. Furthermore, since an optimum drawing temperature and an optimum draw ratio of the undrawn PTT yarn change with time, industrially stabilized production of PTT fibers, showing neither fluff formation nor yarn breakage and suitable for use in clothing, is extremely difficult. In order to inhibit such aging, the following procedures are practiced: in processes disclosed in the patent publications B and D, the birefringence of an undrawn yarn is increased; in a process of the patent publication C, heat treatment at high temperature is conducted at two steps; and in a process disclosed in the patent publication D, the drawing temperature is optimized. However, none of the processes suggest a method of completely avoiding the aging effects of undrawn yarns. Moreover, since all these known processes require the two steps of spinning and drawing, efficient production of the fibers is difficult, and the production cost inevitably increases.

There is the possibility that the problems explained above can be solved by producing a PTT fiber by the so-called spin draw take-up process (hereinafter abbreviated to SDTU process) wherein spinning and drawing are consecutively conducted during the production of a PET fiber or a polyamide fiber. However, little has been known about feasibility of SDTU process for producing PTT fiber. According to a study by the present inventors, when a PTT fiber is produced by the SDTU process used for the production of a PET fiber and a polyamide fiber, the yarn wound on a tube bobbin markedly shrinks, and the tube bobbin is tightened by the shrinking force. In such a situation, the cheese-like package even in an amount as small as several hundreds of grams sometimes cannot be detached from the spindle of the winder (hereinafter the phenomenon is referred to as tight winding). Furthermore, when the winding amount is increased in such a situation, a phenomenon of swelling of the package end faces called bulging takes place by the shrinking force of the yarn even if the package can be detached from the winder due to the use of a tube bobbin having a high strength. When the bulging takes place, a large unwinding tension is produced during unwinding the yarn for the purpose of conducting post-treatment or the like. Consequently, yarn breakage, formation of fluffs and non-uniform dyeing tend to take place. This phenomena, the so-called tight winding, is estimated to take place for the following reasons characteristic to PTT. PTT fiber has a glass transition temperature close to room temperature due to the zigzag structure of PTT molecules, and the yarn after being wound shrinks significantly due to its high elastic recovery.

WO-960080 and Japanese Patent Publication No. 9-3724 disclose methods of consecutively conducting spinning and drawing. However, both patent publications only describe a bulky yarn for carpeting which is consecutively subjected to crimping after spinning and drawing, and describe neither the production of a fiber having a thermal stress and a boil-off shrinkage in predetermined ranges and suitable for use in clothing nor the technology of suppressing the tight winding. Although Chemical Fibers International 47, P 72 (February, 1997) discloses a process for consecutively conducting spinning and drawing, the disclosure refers to production and apparatus, and does not suggest the technologies of producing a fiber having a thermal stress and a boil-off shrinkage in suitable ranges and suitable for clothing.

DISCLOSURE OF THE INVENTION

A first object of the present invention is to provide a PTT fiber which gives a woven or knitted fabric showing neither excessive shrinkage nor resultant stiffness, and manifests the softness expected from the low elastic modulus characteristic of the PTT fiber, and which is excellent in color developing property.

A second object of the present invention is to provide a process for producing a PTT fiber wherein spinning and drawing are consecutively carried out to exclude the influence of the aging of the undrawn yarn, and a low cost fiber is industrially stably produced with high productivity.

Figure 1:
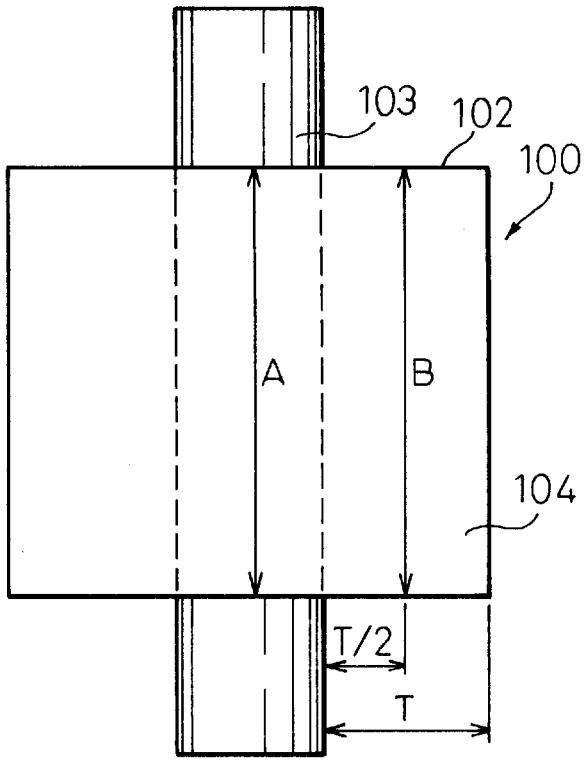
FIG. 1 is a view conceptually showing the shape in a normal state of a cheese-like package of a yarn.

The present inventors have made the following discovery: when a woven or knitted fabric is prepared from a PTT fiber having properties such as a thermal stress and a boil-off shrinkage in specific ranges, the fabric shows neither excessive shrinkage nor resultant stiffness, manifests the softness expected from the low elastic modulus characteristic of the PTT fiber, and is excellent in color developing property. Moreover, they have found a specific SDTU process comprising winding a PTT yarn under specific relaxation conditions during the production of the fiber by the SDTU process. They have thus achieved the present invention.

That is, the present invention provides a polyester fiber comprising 90% or more by weight of a poly(trimethylene terephthalate), and showing a peak value of thermal stress of 0.1 to 0.35 g/d, a boil-off shrinkage of 5 to 16%, a tenacity of 3 g/d or more, an elongation of 20 to 60%, a relationship between an elastic modulus Q (g/d) and an elastic recovery R (%) satisfying the formula (1), and a peak temperature of loss tangent of 90 to 120° C.:

$$0.18 \leqq Q/R \leqq 0.45 \quad (1)$$

The polymer used in the present invention is a polyester comprising 90% or more by weight of PTT.

The PTT is a polyester the acid component of which is terephthalic acid and the diol component of which is trimethylene glycol (also referred to as 1,3-propanediol). The PTT may also contain other copolymer components in an amount of 10% by weight or less. Examples of such copolymer components include ester-forming monomers such as 5-sodium sulfoisophthalic acid, 5-potassium sulfoisophthalic acid, 4-sodium sulfo-2,6-naphthalenedicarboxylate, tetramethylphosphonium 3,5-dicaroboxybenzenesulfonate, tetrabutylphosphonium 3,5-dicarboxybenzenesulfonate, tributylmethylphosphonium 3,5-dicarboxybenzenesulfonate, tetrabutylphoshonium 2,6-dicarboxynaphthalene-4-sulfonate, tetramethylphosphonium 2,6-dicarboxynaphthalene-4-sulfonate, ammonium 3,5-dicarboxybenzenesulfonate, 1,2-butanediol, 1,3-butanediol, 1,4-butanediol, neopentyl glycol, 1,5-pentamethylene glycol, 1,6-hexamethylene glycol, heptamethylene glycol, octamethylene glycol, decamethylene glycol, dodecamethylene glycol, 1,4-cyclohexanediol, 1,3-cyclohexanediol, 1,2-cyclohexanediol, 1,4-cyclohexanedimethanol, 1,3-cyclohexanedimethanol, 1,2-cyclohexanedimethanol, oxalic acid, malonic acid, succinic acid, glutaric acid, adipic acid, heptanedioic acid, octanedioic acid, sebacic acid, dodecanedioic acid, 2-methylglutaric acid, 2-methyladipic acid, fumaric acid, maleic acid, itaconic acid, 1,4-cyclohexanedicarboxylic acid, 1,3-cyclohexanedicarboxylic acid and 1,2-cyclohexanedicarboxylic acid.

Furthermore, various additives such as delustering agents, thermal stabilizers, defoaming agents, isochromatic agents, flame retardants, antioxidants, ultraviolet ray absorbents, infrared ray absorbents, crystallization nucleating agents and optical brighteners may optionally be copolymerized or mixed.

The intrinsic viscosity [η] of a polymer used in the present invention is preferably from 0.4 to 1.5, more preferably from 0.7 to 1.2. A fiber excellent in tenacity and spinnability can be obtained from the polymer having a viscosity in the range mentioned above. When the polymer has an intrinsic viscosity less than 0.4, yarn breakage and formation of fluffs tend to take place during spinning due to an excessively low molecular weight of the polymer, and the yarn hardly manifests the tenacity a clothing fiber is required to have. Conversely, when the intrinsic viscosity exceeds 1.5, melt fracture and failure spinning unpreferably take place during spinning due to an excessively high melt viscosity of the polymer.

Known methods can be used without further modification as a method of producing a polymer used in the present invention. For example, terephthalic acid or a mixture of dimethyl terephthalate and trimethylene glycol is used as a starting material, and one or at least two metal salts selected from titanium tetrabutoxide, titanium tetraisopropoxide, calcium acetate, magnesium acetate, zinc acetate, cobalt acetate, manganese acetate and a mixture of titanium dioxide and silicon dioxide in an amount of 0.03 to 0.1% by weight is added to the starting material. Bishydroxypropyl terephthalate is thus obtained under normal or applied pressure with an ester interchange ratio of 90 to 98%.

Next, one or two or more catalysts such as titanium tetraisopropoxide, titanium tetrabutoxide, antimony trioxide and antimony acetate are added to the reaction product in an amount of 0.03 to 0.15% by weight, preferably 0.03 to 0.1% by weight. The reaction is carried out at temperatures of 250 to 270° C. under reduced pressure. Addition of a stabilizer at an arbitrarily selected stage of polymerization, preferably prior to polycondensation reaction is preferred from the standpoint of improving the whiteness and melt stability, and controlling the formation of organic substances having a molecular weight of 300 or less such as PTT oligomer, acrolein and allyl alcohol. Pentavalent or/and trivalent phosphorus compounds and hindered phenol compounds are preferred as stabilizers in this case. Examples of pentavalent or/and trivalent phosphorus compounds include trimethyl phosphate, triethyl phosphate, tributyl phosphate, triphenyl phosphate, trimethyl phosphite, triethyl phosphite, tributyl phosphite, triphenyl phosphite, phosphoric acid and phosphorous acid. Trimethyl phosphate is particularly preferred. The hindered phenol compound is a phenol derivative having a substituent with steric hindrance at a position adjacent to the phenolic hydroxyl group, and is a compound having at least one ester bond in the molecule. Specific examples of a hindered phenol compound include pentaerythritol tetrakis[3-(3,5-di-tert-butyl-4-hydroxyphenyl) propionate], 1,1,3-tris(2-methyl-4-hydroxy-5-tert-butylphenyl)butane, 1,3,5-trimethyl-2,4,6-tris(3,5-di-tert-butyl-4-hydroxybenzyle)benzene, 3,9-bis{2-[3-(3-tert-butyl-4-hydroxy-5-methylphenyl)propionyloxy]-1,1-dimethylethyl}-2,4,8,10-tetraoxaspiro[5,5]undecane, 1,3,5-tris(4-tert-butyl-3-hydroxy-2,6-dimethylbenzene) isophthalic acid, triethyl glycol bis[3-(3-tert-butyl-5-methyl-4-hydroxyphenyl)propionate], 1,6-hexanediol bis[3-(3,5-di-tert-butyl-4-hydroxyphenyl)propionate], 2,2-thiodiethylene bis[3-(3,5-di-terti-butyl-4-hydroxyphenyl)propionate] and octadecyl 3-(3,5-di-tert-butyl-4-hydroxyphenyl) propionate]. Of the compounds, pentaerythritol tetrakis[3-(3,5-di-tert-butyl-4-hydroxyphenyl)propionate] is preferred.

The polyester fiber of the present invention must show a peak value of a thermal stress of 0.1 to 0.35 g/d and a boil-off shrinkage of 5 to 16%. In order to obtain a fabric having softness, a moderate force for shrinking the yarn and a moderate amount of actual shrinkage must be satisfied. The conditions correspond to the values mentioned above. When the peak value of the thermal stress exceeds 0.35 g/d, the shrinking force becomes too large, and the fabric thus obtained becomes stiff. Moreover, when the peak value is less than 0.1 g/d, the shrinking force becomes too small, and the force of constraining the filaments caused by the fabric structure becomes larger than the shrinking force. As a result, the shrinkage does not take place, and the fabric thus obtained becomes paper-like. A peak value of the thermal stress of 0.1 to 0.25 g/d is particularly preferred because the yarn can be moderately shrunk and a fabric having a very soft feeling can be obtained. When the boil-off shrinkage is less than 5%, the shrinkage amount of the yarn which shows a high peak value of a thermal stress becomes too small, and the fabric becomes paper-like. When the boil-off shrinkage exceeds 16%, the shrinkage of the yarn becomes too large. Consequently, it becomes difficult to obtain a fabric having a desired area or width. Handling of the fabric in the subsequent processing thus becomes difficult. Therefore, the boil-off shrinkage is preferably from 7 to 14%, more preferably from 8 to 12%.

In addition to the peak value of the thermal stress explained above, the peak temperature of the thermal stress (temperature at the peak value of a thermal stress) of the polyester fiber of the present invention is from 100 to 200° C., and the peak value of the thermal stress and the thermal stress at 100° C. preferably satisfy the formula:

$$0.2 \leqq S/T \leqq 0.85$$

wherein T is a peak value (g/d) of a thermal stress, and S is a thermal stress value (g/d) at 100° C.

A woven or knitted fabric is usually passed through the steps of scouring, dyeing and heat setting to give a dyed fabric. In the working steps, the fabric is usually scoured first. Although there is no specific limitation on the scouring temperature, the fabric is usually scoured at temperatures of room temperature to 100° C. When the fabric is markedly shrunk during scouring, not only the production of a dyed fabric having a desired size becomes difficult, but also the fabric becomes stiff. The fabric is ordinarily heat set after scouring at temperatures higher than those of scouring. When the fabric does not shrink to some extent during heat setting, creases formed in the fabric during scouring and dyeing cannot be sufficiently removed. Accordingly, a fabric suitable for clothing applications, having a soft feeling the PTT inherently has and being free from creases can be easily obtained when the peak temperature of the thermal stress is from 100 to 200° C. and the S/T ratio satisfies the formula mentioned above. When the peak temperature of the thermal stress is less than 100° C., the fabric markedly shrinks during scouring or subsequent dyeing, and shows no substantial shrinkage during heat setting. Accordingly, production of a fabric free from creases and having a soft feeling becomes difficult. Moreover, when the peak temperature of the thermal stress is higher than 200° C., the fabric tends to become stiff. The peak temperature of the thermal stress is preferably from 120 to 200° C., more preferably from 130 to 180° C. When the setting temperature of the fabric is defined to be in the temperature range because the yarn shows a maximum thermal stress therein, the fabric can be sufficiently and appropriately shrunk. On the other hand, when the S/T ratio is in the range of 0.2 to 0.85, the fabric shows small shrinkage during scouring and dyeing, and it can be sufficiently shrunk during heat setting. Accordingly, a fabric obtained from a yarn having a S/T ratio of 0.2 to 0.85 is free from creases and has a soft feeling even after finishing the steps of dyeing and heat setting. When the S/T ratio exceeds 0.85, the fabric substantially shows no shrinkage during heat setting because it shrinks during scouring and dyeing, and the fabric thus obtained has many creases. A polyester fiber having a smaller S/T ratio is preferred. However, a PTT fiber having a S/T ratio smaller than 0.2 is difficult to obtain. Although the reason is not definite, the difficulty is thought to arise because the glass transition temperature of the PTT fiber is 100° C. or lower. The S/T ratio is preferably from 0.25 to 0.8, more preferably from 0.3 to 0.75.

The tenacity of the polyester fiber of the present invention is at least 3 g/d. When the tenacity is less than 3 g/d, the burst strength of the knitted fabric lowers. The tenacity is preferably at least 3.3 g/d, more preferably at least 3.5 g/d, still more preferably at least 3.7 g/d. Moreover, the elongation of the fiber is from 20 to 60%. When a PTT fiber is made to have an elongation less than 20% by increasing a draw ratio, formation of fluff and yarn breakage often take place, and the fiber cannot be stably produced. When the elongation exceeds 60%, the nonuniformity in the thickness in the longitudinal direction sometimes becomes high, and the boiling-off shrinkage sometimes becomes significant. When industrial stabilized production or converting processing of the fiber is to be carried out, the elongation is preferably from 30 to 55%, more preferably from 35 to 50%.

The relationship between an elastic modulus Q (g/d) and an elastic recovery R (%) after elongation by 20% and standing for 1 minute, of the polyester fiber of the present invention must satisfy the formula (1):

$$0.18 \leqq Q/R \leqq 0.45 \quad (1)$$

When Q/R>0.45, the elastic modulus becomes too high, and the fabric has no softness. Alternatively, the fiber having been deformed once by stress cannot be restored to the initial state due to the insufficient elastic recovery, and the fabric shows poor shape stability. Conversely, since there substantially exists no region where Q/R<0.18, the lower limit of the Q/R ratio is defined to be 0.18 in the present invention. The specific elastic modulus and elastic recovery which satisfy the formula (1) are usually from 17 to 30 g/d and from 70 to 99%, respectively. The Q/R ratio is preferably from 0.2 to 0.4.

The polyester fiber of the present invention must show a peak temperature (hereinafter abbreviated to $T_{max}$) of a loss tangent determined from the measurement of dynamic viscoelasticity of 90 to 120° C. $T_{max}$ corresponds to the molecular density in the amorphous region. When $T_{max}$ increases, the molecular density therein increases. When $T_{max}$ is lower than 90° C., the molecular density in the amorphous region is too low, and a necessary tenacity cannot be attained. Moreover, when $T_{max}$ is higher than 120° C., the yarn becomes weak against compression and flexing because the orientation in the amorphous portion becomes too high. As a result, the fabric is likely to form fluffs, and is not dyed with a deep color under normal pressure. $T_{max}$ is preferably from 95 to 115° C., more preferably from 100 to 110° C.

The polyester fiber of the present invention preferably is in the form of multifilament yarn when used for clothing applications. Although the total size of the yarn is not restricted, it is usually from 5 to 200 d (denier), preferably from 20 to 150 d. Although the single filament size is not restricted, it is from 0.1 to 10 d, preferably from 0.5 to 5 d, more preferably from 1 to 3 d. There is no limitation on the cross-sectional shape of the fiber. The fiber may have a cross-sectional shape of a circle, a triangle, another polygon, a flat shape, an L shape, a W shape, a cross shape, a # shape, a dog bone shape or the like. The fiber may be a solid or a hollow one. Moreover, 0.2 to 3% by weight of a lubricant may adhere to the surface of the fiber.

The fiber of the present invention is preferably wound in the form of a cheese-like package. In order to readily correspond to modernization and rationalization of the converting processing step in recent years, the fiber is preferably wound into a large package. That is, the fiber is preferably wound into a cheese-like package capable of being formed in a large amount. Furthermore, when the fiber is wound into a cheese-like package, fluctuation in the unwinding tension becomes small at the time of unwinding the fiber during post-processing, and stabilized post-processing becomes possible.

Figure 2:
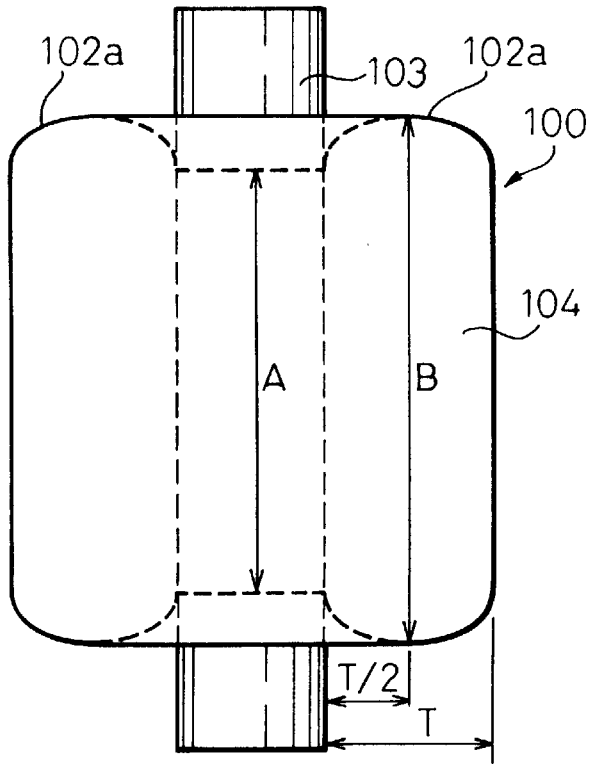
FIG. 2 is a view conceptually showing the shape of a cheese-like package of a yarn in which bulging has occurred.

The bulging rate of a cheese-like package formed by winding the fiber of the present invention is preferably 10% or less. FIG. 1 shows a cheese-like package (100) formed by winding the yarn in a desired form. The yarn is wound on a winding core bobbin (103) such as a tube bobbin in cylindrical yarn layers (104) which form flat end faces (102) at the top and bottom. A bulging is a swollen end face (102*a*) of the cheese-like package (100) formed when a tightening force caused by shrinkage of the package yarn due to the tightened winding is strongly exerted, as shown in FIG. 2. The bulging rate herein is a value calculated by the following formula:

$$\text{bulging rate} = \{(B-A)/A\} \times 100\%$$

wherein A is a winding width of the innermost layer shown in FIG. 1 or 2, T is a thickness of the wound yarn, and B is a winding width at a thickness of T/2 from the innermost layer.

The bulging rate becomes a parameter showing a degree of tight winding. When the bulging rate of the cheese-like package exceeds 10%, the tight winding becomes significant, and the package often cannot be detached from the spindle of the winder; moreover, yarn breakage, formation of fluffs, uneven dyeing and the like, caused by the nonuniformity of the unwinding tension tend to take place. The bulging rate is preferably 5% or less, most preferably 0% of course. Cheese-like packages of the present invention are used in the following manner: when a cheese-like package is entirely used in a weaving or knitting step or false-twisting step, another cheese-like package is linked behind the preceding one, and used. It is extremely important to reduce the frequency of the linking from the standpoint of improving the operation frequency and cutting the cost. Accordingly, the cheese-like package is formed by winding preferably at least 1 kg, more preferably at least 3 kg, still more preferably at least 5 kg of the fiber of the present invention. The tube bobbin used for the cheese-like package may be made of either a resin such as a phenol resin, a metal, or paper. When the tube bobbin is made of paper, the tube preferably has a thickness of at least 5 mm. The tube bobbin preferably has an outside diameter of 100 to 300 mm and a winding width of 100 to 400 mm in view of its handling.

In order to obtain the polyester fiber of the present invention, it is important that the yarn be drawn (orientation of the molecules), heat treated (crystallization), and subjected to relaxation treatment (orientation relaxation in the amorphous region). Since the molecules of PTT are soft compared with those of PET, the amorphous region are forcibly elongated to become stretched when the yarn is drawn. When the yarn is crystallized after drawing to fix the structure, the amorphous region of the PTT cannot be sufficiently fixed. As a result, the forcibly elongated amorphous region shrink greatly when the yarn is heated, and the thermal stress and boil-off shrinkage become high. When the draw ratio is lowered to make the amorphous region become unelongated much for the purpose of lowering the thermal stress and boil-off shrinkage to moderate values, the orientation degree of the yarn is lowered, and the strength and elastic recovery are also lowered, whereby the fiber shows a high elongation. Therefore, in order to lower the stretch of the amorphous region of the yarn, conducting relaxing treatment (relaxation treatment) after drawing and crystallization of the yarn becomes important.

Examples of the process for obtaining the polyester fiber of the present invention include a process comprising drawing an undrawn wound yarn, and the SDTU process wherein spinning and drawing are consecutively conducted. However, use of the SDTU process is preferred for the reasons explained below. Structure changes such as formation of microcrystals take place in the undrawn yarn of a PTT even at temperatures close to room temperature, and formation of fluffs and yarn breakage occur during drawing. On the other hand, microcrystals are seldom formed prior to drawing in the SDTU process because the undrawn state continues for only an extremely short period of time. Moreover, when the yarn is drawn while the microcrystals are present, the degree of stretch in the amorphous region increases, and the thermal stress and thermal shrinkage of the yarn become high. Production of the fiber by the SDTU process with high relaxation comprising highly relaxing the yarn prior to winding is particularly preferred from the standpoint of making the physical properties of the fiber optimum and suppressing the tight winding. One example of the production process of the present invention in which the SDTU process with high relaxation is employed will be explained below in detail.

The fiber of the present invention is obtained by a process wherein molten multifilaments extruded from the spinning nozzle of a spinning machine are passed through a retarded cooling zone 2 to 80 cm long provided directly below the spinning nozzle and held at atmospheric temperatures of 30 to 200° C., the molten filaments are rapidly cooled to be changed into solid filaments, the solid filaments are wound round a first roll heated at 30 to 80° C. and having a peripheral speed of 300 to 3,500 m/min without winding thereon, the filaments are wound round a second roll heated at 100 to 160° C., whereby the filaments are drawn at a draw ratio 1.3 to 4 between the first and the second roll having a peripheral speed higher than that of the first one, and the filaments are wound on a winder having a speed lower than that of the second roll.

Figure 3:
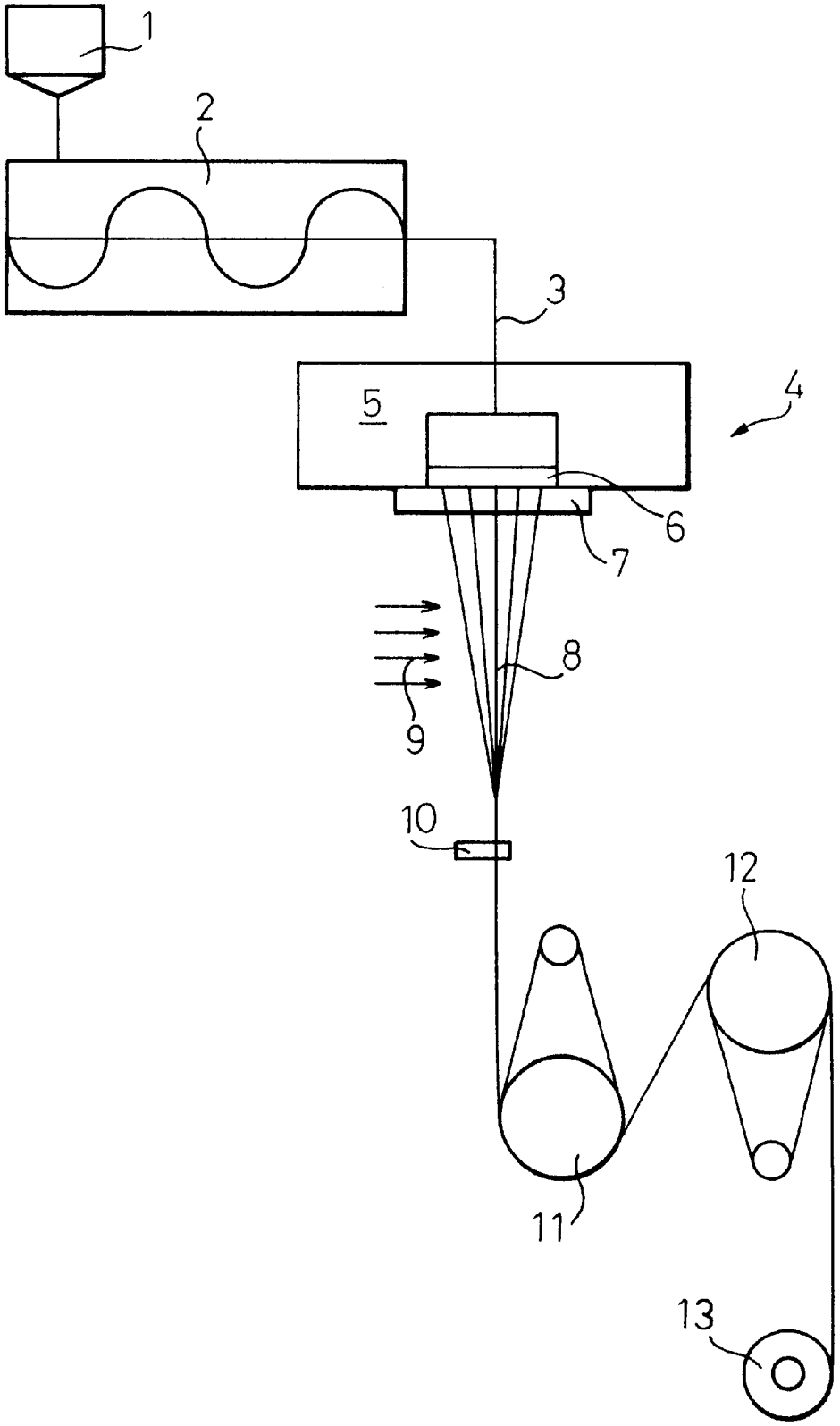
FIG. 3 is a view conceptually illustrating a process for producing a fiber in which spinning and drawing are consecutively conducted.
Figure 4:
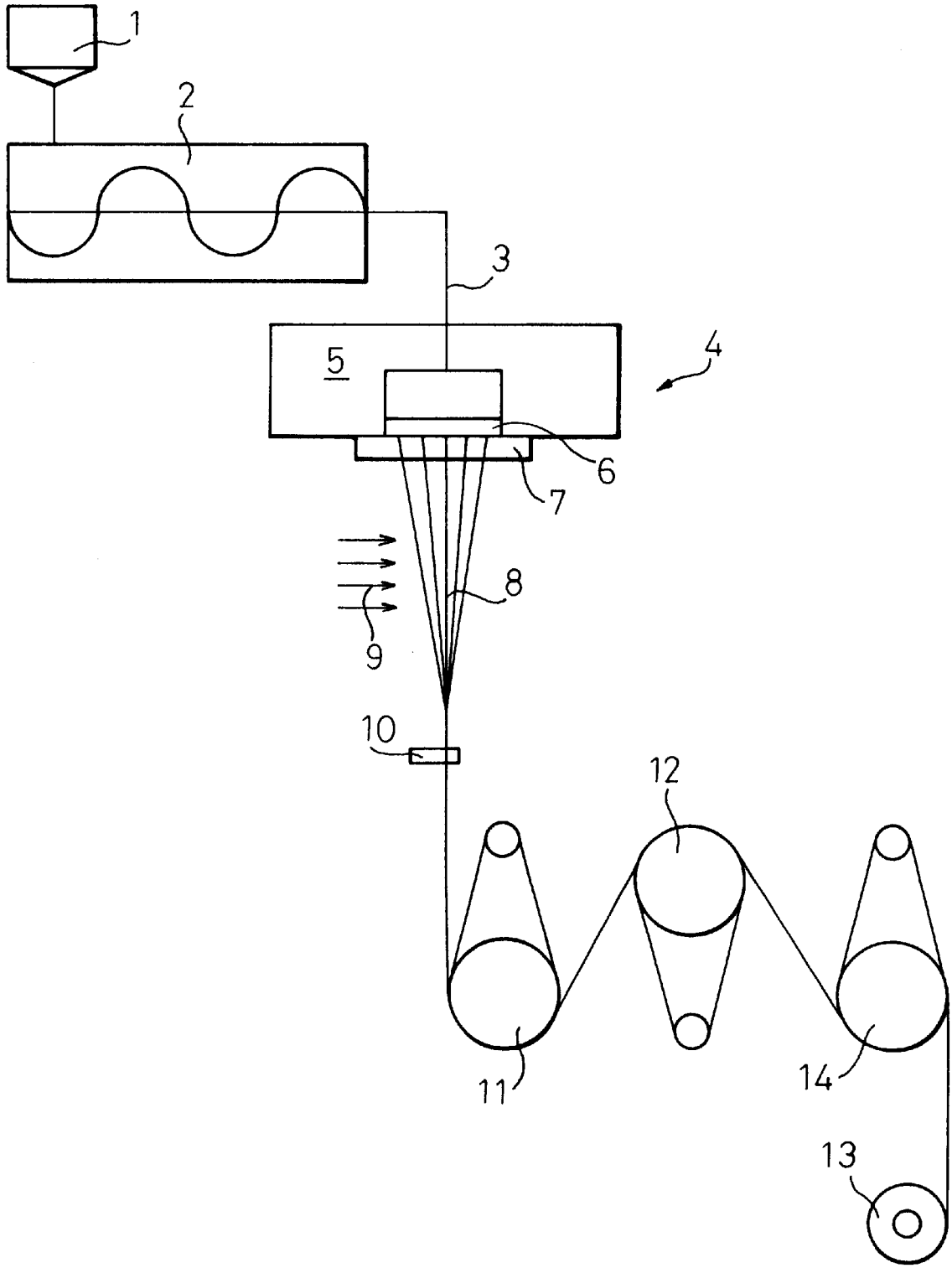
FIG. 4 is a view conceptually illustrating another process for producing a fiber in which spinning and drawing are consecutively conducted.

A preferred production process of the PTT fiber of the present invention will be explained below in detail using FIGS. 3 and 4.

PTT pellets dried with a drier (1) to have a moisture content of 100 ppm or less are fed to an extruder (2) set at temperatures of 250 to 290° C., and melted. The molten PTT is sent to a spin head (4) set at a temperature from 250 to 290° C. through a bend (3). The molten PPT is then weighed with a gear pump, and extruded into a spinning chamber (not shown) as molten multifilaments through a spinneret (6) mounted on a pack (5) and having a plurality of orifices. The moisture content of the PTT pellets fed to the extruder is preferably 50 ppm or less, more preferably 30 ppm or less from the standpoint of preventing the degree of polymerization of polymer from lowering. The most suitable temperature of the extruder and that of the spin head must be selected from those which are in the range mentioned above by taking the intrinsic viscosity and shape of the PTT pellets into consideration; the temperatures are preferably from 255 to 280° C. When the spinning temperature is less than 250° C., the tenacity thus manifested tends to lower. Moreover, when the spinning temperature exceeds 290° C., the thermal decomposition of the polyester becomes a problem. As a result, the yarn thus obtained is colored, and does not show a satisfactory tenacity.

Molten multifilaments (8) extruded into the spinning chamber are cooled to room temperature by cooling air (9), and changed into solidified multifilaments. Before the change, the molten multifilaments are passed through a retarded cooling zone (7) 2 to 80 cm long held at atmospheric temperatures of 30 to 200° C. and provided directly below the spinning nozzle, whereby drastic cooling of the molten multifilaments is suppressed. The molten multifilaments are then rapidly cooled to be changed into the solid ones, which are provided to the following drawing step. Nonuniform solidification of the multifilaments is suppressed by passing them through the retarded cooling zone; the molten multifilaments can be changed into the solid ones without uneven solidification (uneven thickness and nonuniform orientation) at a high winding speed or at a first roll speed. When the temperature of the retarded cooling zone is lower than 30° C., the molten multifilaments are rapidly cooled, and uneven solidification of the solidified multifilament tends to become significant. Moreover, yarn breakage is likely to occur when the temperature is 200° C. or more. The temperature of the retarded cooling zone is preferably from 40 to 180° C., more preferably from 50 to 150° C., and the length thereof is preferably from 5 to 30 cm.

The solidified multifilaments are then wound round a first roll (11) heated at 30 to 80° C. and rotated at a peripheral speed of 300 to 3,500 m/min. Prior to winding them round the first roll, a finishing agent is preferably imparted with a finishing agent-imparting apparatus (10). Imparting a finishing agent improves the cohesiveness, the antistatic property, the slippage property and the like, of the fiber. As a result, formation of yarn with fussiness and yarn breakage of the fiber is suppressed during drawing and winding it, and the package thus wound can be maintained in a good form. The finishing agent herein designates an aqueous emulsion obtained by emulsifying a lubricant with an emulsifying agent, a solution obtained by dissolving a lubricant in a solvent, or a lubricant itself. The finishing agent improves the cohesiveness, antistatic property, slipping property and the like, of the fiber. The finishing agent to be imparted is one of the agents mentioned above, or a mixture of at least two of them. The lubricant herein is a mixture containing from 10 to 80% by weight of an aliphatic ester and/or mineral oil, or/and from 50 to 98% by weight of a polyether having a molecular weight of 1,000 to 20,000; the components are preferably optionally selected. When the lubricant is diluted with an aqueous emulsion and a solvent, the finishing agent contains preferably from 5 to 99% by weight, more preferably from 10 to 50% by weight of the lubricant based on the finishing agent. The finishing agent is imparted to the fiber so that the lubricant adheres to the fiber in an amount of preferably 0.2 to 3% by weight, more preferably 0.4 to 2% by weight based on the fiber. When the proportion of the lubricant is less than 5% by weight, the amount of water or solvent that volatilizes on the heated first roll (11) or second roll (12) becomes excessive. Consequently, uniform holding of the fiber at a given temperature becomes difficult because the fiber is deprived of heat due to the heat of vaporization. As a result, nonuniform drawing or heat treatment takes place, and uneven dyeing etc., occurs. The proportion of the lubricant may be 100% by weight. However, in order to lower the viscosity of the finishing agent and allow the finishing agent to uniformly adhere to the yarn, the proportion is preferably 50% by weight or less. When the amount of the lubricant adhering to the fiber is less than 0.2%, the cohesiveness, antistatic property, slippage property and the like, of the fiber are deteriorated, although an improvement of these properties is the object of imparting the finishing agent. As a result, formation of fluffs and yarn breakage often take place during drawing, winding and post-treatment, and the package thus wound takes an unsuitable form. When the amount of adhesion of the lubricant exceeds 3% by weight, the following disadvantages results. The fiber becomes sticky, and handling the fiber becomes difficult; the lubricant adheres to guides and rolls used for spinning or winding to pollute them and cause formation of fluffs and yarn breakage. The known method of using an oiling roll and that of using a guide nozzle disclosed in, for example, Japanese Unexamined Patent Publication (Kokai) No. 59-116404 can be employed as methods of imparting the finishing agent. Of these methods, the method of using a guide nozzle is preferred.

The multifilaments wound round the first roll (11) are then wound round the second roll (12) heated at temperatures of 100 to 160° C. without winding them, and drawn at a draw ratio of 1.3 to 1.4 between the first roll (11) and the second roll (12) having a peripheral speed higher than that of the first one, followed by winding them on a winder (13) rotating at a speed lower than that of the second roll (12). In the course of spinning, interlace treatment may optionally be applied. The undrawn yarn once wound at a spinning speed of 300 to 3,500 m/min can also be wound through the first roll (11) and the second roll (12).

It is important that the peripheral speed of the first roll (11) be from 300 to 3,500 m/min. Although the spinning stability is excellent when the peripheral speed of the first roll (11) is less than 300 m/min, the productivity is greatly reduced. When the peripheral speed exceeds 3,500 m/min, orientation in the amorphous region and partial crystallization proceed before winding, and the draw ratio cannot be increased in the drawing step. As a result, the molecules cannot be oriented, and a sufficient yarn tenacity can hardly be obtained. The peripheral speed is preferably from 800 to 3,000 m/min, more preferably from 1,200 to 2,500 m/min.

Although the peripheral speed of the second roll (12) is determined by the draw ratio, it is usually from 600 to 6,000 m/min. The draw ratio between the first roll (11) and the second roll (12) is from 1.3 to 4, preferably from 1.5 to 3. When the draw ratio is less than 1.3, the polymer cannot be oriented sufficiently, and the tenacity and elastic recovery of the yarn thus obtained become low. Moreover, when the draw ratio exceeds 4, formation of fluffs and yarn breakage become a problem, and drawing cannot be conducted stably. The temperature of the first roll (11) is from 30 to 80° C., where easy drawing of the yarn can be attained. The temperature range is preferably from 40 to 70° C., more preferably from 45 to 65° C. The temperature of the second roll (12) should be from 100 to 160° C. When the roll temperature is less than 100° C., the yarn is not crystallized sufficiently; accordingly a fiber having the thermal stress, boil-off shrinkage and tenacity the present invention is intended to attain cannot be obtained. Moreover, when the roll temperature exceeds 160° C., formation of fluffs and yarn breakage take place, and stabilized spinning becomes difficult. The roll temperature is preferably from 120 to 150° C.

It is particularly important in the SDTU process with high relaxation to make the speed of the winder (13) lower than the peripheral speed of the second roll (12). When the PTT fiber is produced by a process wherein spinning and drawing are consecutively conducted at a winding speed equal to or higher than the second roll speed, the fiber cannot be relaxed sufficiently. Therefore, not only a fiber having the thermal stress, boil-off shrinkage and tenacity the present invention is intended to attain cannot be obtained, but also the wound fiber shrinks. As a result, tight winding takes place even when the fiber is wound in an amount as small 1 kg or less because the shrinking force tightens the tube bobbin. Furthermore, when the winding amount is increased under such a situation, a cheese-like package having a bulging rate of larger than 10% is formed even when the tube bobbin can be detached from the spindle of the winder by the use of a tube bobbin having a high strength.

In contrast, a fiber having the thermal stress, boil-off shrinkage and tenacity the present invention intends to attain can be obtained only when the speed of the winder (13) is made lower than the peripheral speed of the second roll (12); moreover, the tight winding and formation of the bulging of the package thus obtained can be suppressed. Furthermore, orientation relaxation in the amorphous region of the fiber makes the amorphous region loose, and the fiber comes to have a structure where a dye can easily enter so as to improve the dyeing property. The relaxation ratio (winding speed/peripheral speed of the second roll) is preferably from 0.8 to 0.999, more preferably from 0.83 to 0.99, still more preferably from 0.85 to 0.95. Such a large relaxation ratio is a significant feature of the production of a PTT fiber by the SDTU process. The relaxation ratio becomes large because the PTT yarn is markedly drawn by a small tension such as a winding tension due to a low elastic modulus of the PTT fiber. When such a high relaxation ratio is applied to a fiber having a high elastic modulus such as a PET fiber, either the yarn cannot be wound because the yarn is loosened between the second roll and the winder, or collapsed winding takes place even if the yarn can be wound to form a cheese-like package.

However, application of such a large relaxation ratio sometimes results in tight winding of the yarn when the amount of the yarn wound exceeds 2 kg. When deformation of the tube bobbin caused by tight winding is prevented in this case by the use of a high strength tubular bobbin made of resin, metal or thick paper, the tubular bobbin can be easily detached from the spindle of the winder. Winding the yarn in an amount as small as, for example, 2 kg or less is also an effective method of suppressing the tight winding. In order to suppress more surely the tight winding, it is particularly preferred to cool the multifilaments prior to winding to a temperature of (glass transition temperature of the polymer +20)° C. or less. Since the molecules of a PTT have a flexible structure, the PTT can easily move at relatively low temperature compared with, for example, a PET. The PTT therefore tends to be shrunk by heat during winding, and show extremely easily tight winding. Cooling the multifilaments as explained above makes it possible to suppress the molecular movement, and as a result the tight winding can be suppressed. When the fiber temperature subsequent to cooling is lower, better results can be obtained. The fiber temperature is usually from 10 to 70° C., preferably from 0 to 50° C. Methods including the following ones can be used for cooling the yarn: a method comprising blowing a cold wind; a method comprising immersing the yarn in a cooling liquid such as water or an organic solvent; and a method comprising sliding the yarn on a plate or a roll at low temperature. A method which will be explained later by making reference to FIG. 4, and in which a third roll (14) is used is most preferred. In the method, the winding amount of the fiber can be made 2 kg or more, preferably at least 5 kg.

The tension of the fiber between the second roll (12) and the winder (13) is preferably from 0.05 to 0.4 g/d, more preferably from 0.07 to 0.25 g/d. When the tension is less than 0.05 g/d, the tension is too small. As a result, the yarn cannot be traversed well in the traverse guide of the winder, and the wound form becomes improper. When the tension exceeds 0.4 g/d, tight winding often takes place even if the yarn is cooled and wound.

In order to efficiently suppress the tight winding, the following spinning method is preferred. As shown in FIG. 4, the multifilaments are wound round the third roll (14) subsequently to the second roll (12), and wound using a winder. In this case, the yarn is cooled on the third roll (14), and it can be relaxed between the second roll (12) and the third roll (14) and/or between the third roll (14) and the winder (13). The relaxation ratio (ratio of a peripheral speed of the third roll to a peripheral speed of the second roll, or ratio of a winding speed to a peripheral speed of the third roll) is preferably from 0.8 to 0.999, more preferably from 0.82 to 0.99, still more preferably from 0.85 to 0.95. In order to suppress the tight winding, the yarn is preferably relaxed between the third roll and the second roll (12). It is particularly preferred to cool the third roll (14) to (glass transition temperature of the polymer +20)° C. or lower. The temperature is usually from 10 to 70° C., preferably from 0 to 50° C. The tension of the yarn between the third roll (14) and the winder (13) is preferably from 0.05 to 0.4 g/d, more preferably from 0.07 to 0.25 g/d. It is preferred to adjust the winding speed in such a manner that the tension of the yarn falls into a preferred range.

When a fabric thus obtained is partly or entirely formed with the polyester fiber of the present invention, the fabric becomes excellent in softness, stretchability properties and color developing properties and it can be used for innerwear, outerwear, sportswear, lining cloths, legwear and the like.

The fabric partly or entirely formed with the polyester fiber of the present invention includes a woven fabric such as taffeta, twill, satin, crepe de Chine, palace crepe and georgette crepe, a knitted fabric such as a plain knitted fabric, a rib-stitched fabric, an interlock knitted fabric, a single tricot knitted fabric and a half tricot fabric, nonwoven fabric, and the like. There is no specific limitation on the form of the fiber; the fiber may be as-drawn flat yarn, a twisted yarn, a textured yarn, or the like. The fabric may of course be subjected to conventional processing such as scouring, dyeing and heat setting, and it may also be sewn as a clothings. A fabric partly formed with the polyester fiber of the present invention includes a fiber composite fabric in which at least one fiber selected from synthetic fibers, chemical fibers and natural fibers such as cellulose fibers, wool, silk, stretched fibers and acetate fibers is used in combination. There is no specific limitation on the form and mixing method of the polyester fiber of the present invention, and known methods can be employed. Using the polyester fiber as a warp or weft is one embodiment of the mixing method, and the resultant products include a woven fabric such as a mixed woven fabric and a reversible woven fabric, and a knitted fabric such as tricot and raschel fabric. The mixing methods may also include a composite twisting, doubling or plying and interlacing.

There is no specific limitation on the cellulose fibers used for the fiber composite fabric. Examples of the cellulose fibers include natural fibers such as cotton and hemp, cuprammonium rayon, rayon and polynosic rayon. Although there is no specific limitation on the content of the polyester fiber in the fiber composite fabric, the content is preferably from 25 to 75% in order to make use of the feeling, moisture absorption, water absorption and antistatic property of the cellulose fibers.

Commercially available wool and silk can be used for the fiber composite fabric without further processing. Although there is no specific limitation on the content of the polyester fiber in the fiber composite fabric, the content is preferably from 25 to 75% in order to make use of the feeling, warmth and bulkiness of the wool, and the feeling and Kishimi (creak) of the silk.

There is no specific limitation on the stretched fibers used for the fiber composite fabric. Examples of the stretched fibers include a dry or melt spun polyurethane fiber and a polyester-based elastic yarn represented by a polybutylene terephthalate fiber and a fiber of polybutylene terephthalate copolymerized with polytetramethylene glycol. The content of the polyester fiber in the fiber composite fabric in which a stretched fiber is used is preferably from about 60 to 98%. Since the stretchability of the stretched fiber is suppressed when the content of the polyester fiber exceeds 70%, the resultant fabric can be used for the applications of outerwear, casualwear and the like. When the content is less than 70%, the resultant fabric can be used for the applications of innerwear, foundation, swimwear and the like.

A diacetate fiber or a triacetate fiber may be used as the acetate fiber used for the fiber composite fabric. Acetate fibers are dyed with a disperse dye similarly to polyester fibers. As a result of mixing an acetate fiber with the polyester fiber of the present invention, the resultant fabric can be dyed at 110° C. or lower. Therefore, the fabric has a good feeling, and can be processed at low dyeing cost. When a diacetate fiber which has poor thermal stability is mixed with the polyester fiber of the present invention, the effect of lowering the dyeing temperature of the present invention can be fully utilized. Although there is no specific limitation on the content of the polyester fiber in the fiber composite fabric, the content is preferably from 25 to 75% in order to make use of the feeling, brightness of color and luster of the acetate fiber.

The fabrics of the present invention including a fiber composite fabric may be dyed. For example, the fabrics prepared by knitting or weaving are preferably dyed after conventional scouring, pre-setting, dyeing and final setting. Moreover, after scouring and prior to dyeing, the fabrics are preferably subjected to a caustic reduction treatment if necessary.

The fabrics are preferably scoured at 40 to 98° C. In particular, when a stretch fiber is mixed, the fabric is preferably scoured while being relaxed because the elasticity of the fabric is improved.

Although heat setting before and/or after dyeing can be omitted, heat setting before and after dyeing is preferably conducted in order to improve the shape stability and dying property of the fabric. The heat setting temperature is from 120 to 190° C., preferably from 140 to 180° C. The heat setting time is from 10 sec to 5 minutes, preferably from 20 sec to 3 minutes.

The fabric can be dyed without using a carrier at a temperatures of 70 to 150° C., preferably 90 to 130° C., particularly preferably 90 to 110° C. The dyeing time should be from 20 to 300 minutes, preferably from 30 to 120 minutes. The pH of the dyeing bath is adjusted in accordance with the dye using acetic acid, sodium hydroxide or the like, and use of a dispersant containing a surfactant is particularly preferred.

After dyeing, the fabric is preferably soaped or reduction-cleaned by known methods. The methods may be known ones; for example, the fabric can be treated in an aqueous solution of alkaline substance such as sodium carbonate or sodium hydroxide using a reducing agent such as sodium hydrosulfite.

Best Mode for Carrying Out the Invention

The present invention will be explained below in more detail by making reference to examples. However, the present invention is in no way restricted thereto. The production conditions of fibers in examples and comparative examples and the physical properties of the fibers thus obtained are shown in Table 1 and Table 2, respectively.

In addition, major measured values in examples are obtained by the methods explained below.

(1) Intrinsic viscosity

An Ostwald viscometer and o-chlorophenol at 35° C. are used. The ratio $\eta_{sp}/C$ of a specific viscosity $\eta_{sp}$ to a concentration C (g/100 ml) is extrapolated to the concentration of zero, and the intrinsic viscosity [η] is obtained by the following formula:

$$[\eta] = \lim_{C \to 0} (\eta_{sp} / C)$$

(2) Loss Tangent

Using a Leovibron manufactured by Orientech K.K., the loss tangent (tan δ) and the dynamic elastic modulus of a sample is measured at a frequency of 110 Hz, at predetermined temperatures in dried air while the sample is being heated at a rate of 5° C./min,. A loss tangent-temperature curve is obtained from the results, and the peak temperature of the loss tangent $T_{max}$(° C.) is determined on the curve.

(3) Boil-Off Shrinkage

The boil-off shrinkage is obtained as a hank shrinkage, on the basis of JIS L 1013.

(4) Tenacity (tenacity at break), Elongation (elongation at rupture of fiber) and Elastic Modulus (initial resistance to tensile stretch)

Measurements are made on a sample on the basis of JIS L 1013 using a Tensilon (manufactured by Orientech K.K.) which is a tensile testing machine of the constant rate drawing type while the grip interval and tensile speed are set at 20 cm and 20 cm/min, respectively.

(5) Elastic Recovery

A yarn is attached to a tensile testing machine of constant rate stretching type with a chuck-to-chuck distance set at 20 cm, stretched at a tensile rate of 20 cm/min until the elongation becomes 20%, and allowed to stand for 1 minute. The yarn is subsequently shrunk at the same rate, thereby drawing a stress-strain curve. The elongation of the yarn at the time when the stress becomes zero during shrinking is termed a residual elongation (La). The elastic recovery is obtained from the following formula:

$$\text{Elastic recovery} = (20 - La)/20 \times 100(\%)$$

(6) Thermal Stress

A KE-2 manufactured by Kanebo Engineering Ltd. is used. The thermal stress of a sample is measured at a heating rate of 100° C./min with the initial load set at 0.05 g/d. A thermal stress (axis of ordinates) is plotted against a temperature (axis of abscissas) from the data thus obtained to give a temperature-thermal stress curve. The maximum value of the thermal stress is defined as a peak value thereof, and the temperature at the peak value is defined as a peak temperature of thereof. Moreover, the thermal stress at 100° C. is read.

(7) Bulging Rate

The winding width of the innermost layer of yarn layers (104) shown in FIG. 1 or 2 is represented by A, and the thickness of the wound yarn is represented by T. The winding width B at a thickness of T/2 from the innermost layer is measured, and the bulging rate is calculated from the following formula:

$$\text{Bulging rate} = \{(B - A)/A\} \times 100\%$$

(8) Adhesion Amount of Lubricant

A yarn is extracted with diethyl ether on the basis of JIS L 1013, and the diethyl ether-extracted fraction is defined as the adhesion amount.

EXAMPLE 1

Dimethyl terephthalate and 1,3-propanediol were placed in a reaction vessel in a molar ratio of 1:2, and titanium tetrabutoxide was added in an amount corresponding to 0.1% by weight of dimethyl terephthalate. The mixture was heated at a heater temperature of 240° C. under normal pressure to complete an ester interchange reaction. Titanium tetrabutoxide was further added in an amount corresponding to 0.1% by weight of the theoretical polymer amount, and the reaction was effected at 270° C. for 3 hours. The polymer thus obtained had an intrinsic viscosity of 1.0.

The polymer thus obtained was conventionally dried to have a moisture content of 50 ppm, was melted at 285° C., and was extruded through a spinning nozzle having 36 orifices arrayed in a single row each having a diameter of 0.23 mm. The molten multifilaments thus extruded were passed through a retarded cooling zone 5 cm long at 100° C., and then rapidly cooled, by blowing air at a speed of 0.4 m/min, to be changed into solidified multifilaments. An aqueous emulsion finishing agent containing 10% by weight of a lubricant was prepared. The finishing agent contained 60% by weight of octyl stearate, 15% by weight of polyoxyethylene alkyl ether and 3% by weight of potassium phosphate. The yarn was treated with the finishing agent so that 1% by weight of the finish oil is imparted to the fiber. The solidified multifilaments were then passed between a first roll (11) heated to 60° C. and rotated at a peripheral speed of 2,100 m/min and a second roll (12) heated to 133° C. and rotated at a peripheral speed of 4,300 m/min so that the filaments were heat drawn and heat set. Thereafter, the multifilaments were wound on a tubular bobbin (13) made of a phenol resin, having an outside diameter of 110 mm and a length of 350 mm with the winding width set at 300 mm to give a cheese-like package in an amount of 1 kg. The size of the yarn thus obtained was set at 75 d/36 f.

The physical properties of the fiber thus obtained are shown in Table 2. The fiber thus obtained was in the scope of the present invention. Neither yarn breakage nor formation of fluffs was observed. The bulging rate of the cheese-like package thus obtained was in the scope of the present invention.

EXAMPLES 2 TO 4

Using the polymer in Example 1, fibers having a size of 75 d/36 f were obtained under the conditions shown in Table 1. The physical properties of the fibers thus obtained are shown in Table 2. Each of the fibers was in the scope of the present invention. Neither the yarn breakage nor the formation of fluffs was observed during spinning. The bulging rates of the cheese-like packages thus obtained were in the scope of the present invention.

EXAMPLE 5

Using the polymer in Example 1, the yarn thus obtained was wound, in an amount of 1.5 kg, on a tubular bobbin (13) made of paper 7 mm thick and having an outside diameter of 110 mm and a length of 350 mm with the winding width set at 300 mm to give a cheese-like package formed with a yarn having a size of 75 d/36 f. The physical properties of the fiber thus obtained are shown in Table 2. The fiber falls within the scope of the present invention. Neither the yarn breakage nor the formation of fluffs was observed in the step of spinning. Moreover, the cheese-like package thus wound could be easily detached from the spindle of the winder, and the bulging rate was in a good range.

EXAMPLE 6

Dimethyl terephthalate and 1,3-propanediol were placed in a reaction vessel in a molar ratio of 1:2, and a mixture of calcium acetate and cobalt acetate tetrahydrate in a ratio of 7:1 was added in an amount of 0.1% by weight based on dimethyl terephthalate. The mixture was heated at a heater temperature of 240° C. under normal pressure to effect ester interchange. Next, titanium tetrabutoxide in an amount of 0.1% by weight and trimethyl phosphate in an amount of 0.05% by weight based on dimethyl terephthalate were added, and the mixture was reacted for 3 hours at 270° C. under pressure of 0.2 Torr. The polymer thus obtained had an intrinsic viscosity of 0.7.

The polymer thus obtained was conventionally dried to have a moisture content of 40 ppm, melted at 285° C., and extruded through a spinning nozzle having singly arranged 36 orifices each having a diameter of 0.23 mm. The molten multifilaments thus extruded were passed through a retarded cooling zone 2 cm long at 60° C., and then rapidly cooled by blowing air at a speed of 0.35 m/min to be changed into solidified multifilaments. Next, an aqueous emulsion finishing agent containing 10% by weight of the same finishing agent as in Example 1 was allowed to adhere to the yarn in an amount of 1% by weight as the finishing agent. The solidified multifilaments were then passed between a first roll heated to 50° C. and rotated at a peripheral speed of 1,125 m/min and a second roll heated to 140° C. and rotated at a peripheral speed of 3,600 m/min so that the filaments were heat drawn and heat set. Thereafter, the multifilaments were wound on a tubular bobbin made of a phenol resin, and having an outside diameter of 110 mm and a length of 350 mm with the winding width set at 300 mm to give a cheese-like package in an amount of 1 kg. The size of the fiber thus obtained was set at 75 d/36 f. The physical properties of the fiber thus obtained are shown in Table 2. The fiber thus obtained was in the scope of the present invention. Neither the yarn breakage nor the formation of fluffs was observed in the step of spinning. The bulging rate of the cheese-like package thus obtained was in the scope of the present invention.

EXAMPLES 7 TO 9

Using the polymer in Example 6, fibers of 75 d/36 f were obtained under the conditions shown in Table 1. The physical properties of the fibers thus obtained are shown in Table 2. The fibers thus obtained were in the scope of the present invention. Neither the yarn breakage nor the formation of fluffs was observed in the step of spinning. The bulging rates of the cheese-like packages thus obtained were in the scope of the present invention.

EXAMPLE 10

Using the polymer in Example 6, a fiber of 75 d/36 f was obtained under the conditions in Table 2. The yarn was wound, in an amount of 1.5 kg, on a tubular bobbin made of paper 7 mm thick and having an outside diameter of 110 mm and a length of 350 mm with the winding width set at 300 mm to give a cheese-like package. The physical properties of the fiber thus obtained are shown in Table 2. The fiber corresponds to the scope of the present invention. Neither the yarn breakage nor the formation of fluffs was observed in the step of spinning. The cheese-like package thus wound could be easily detached from the spindle of the winder, and showed a small bulging rate.

EXAMPLES 11 TO 12

A polymer obtained in the same manner as in Example 6 and having an intrinsic viscosity of 0.93 and a glass transition temperature of 51° C. was used. A third roll arranged between the second roll and the winder was used. Yarns of 75 d/36 f obtained under the conditions shown in Table 1 were each wound, in an amount of 5 kg, on a tubular bobbin made of paper 7 mm thick and having an outside diameter of 110 mm and a length of 350 mm with the winding width set at 300 mm to give a cheese-like package. The physical properties of the fibers thus obtained are shown in Table 2. The fibers correspond to the scope of the present invention. Neither the yarn breakage nor the formation of fluffs was observed in the step of spinning. The cheese-like packages thus wound each could be easily detached from the spindle of the winder, and each showed a very small bulging rate and no tight winding.

EXAMPLE 13

Using a polymer with an intrisic viscosity of 1.0 obtained in the same manner as in Example 6 except that a PTT (intrinsic viscosity of 0.7) containing 2% by mole of copolymerized 5-sodium sulfoisophthalic acid was used, a fiber of 75 d/36 f was obtained under the conditions shown in Table 1. The physical properties of the fiber thus obtained are shown in Table 2. The fiber corresponds to the scope of the present invention. Neither the yarn breakage nor the formation of fluffs was observed in the step of spinning. The bulging rate of the cheese-like package thus obtained was in the scope of the present invention.

COMPARATIVE EXAMPLE 1 TO 6

The polymer in Example 1 was used, and yarns having a size of 75 d/36 f were prepared under conditions shown in Table 1. A cheese-like package was wound using each of the yarns thus obtained on a tubular bobbin made of paper 7 mm thick and having an outside diameter of 110 mm and a length of 350 mm with a winding width set at 300 mm. The physical properties of the yarns thus obtained are shown in Table 2. Each of the yarns obtained in Comparative Examples 2, 3 and 5 showed drastic yarn breakage, and could not be wound. The tube bobbin on which any of the yarns in Comparative Examples 1, 4 and 6 was wound could not be detached from the spindle of the winder when the wound amount was 0.5 kg. Moreover, the fibers thus obtained were outside the scope of the present invention. The bulging rate of the cheese-like package formed by winding 5 kg of the yarn under conditions in Comparative Example 1 was 15%.

COMPARATIVE EXAMPLE 7

The polymer in Example 11 was used, and a fiber of 75 d/36 f was prepared under conditions shown in Table 1. A cheese-like package was wound by using the yarn thus obtained on a tubular bobbin made of paper 7 mm thick and having an outside diameter of 110 mm and a length of 350 mm with a winding width set at 300 mm. The tubular bobbin on which the yarn was wound could not be detached from the spindle of the winder when the wound amount was 0.5 kg. The fiber thus obtained was outside the scope of the present invention.

The bulging rate of the cheese-like package formed by winding 5 kg of the yarn was 16%.

COMPARATIVE EXAMPLE 8

The polymer obtained in Comparative Example 1 was dried according to a conventional manner to have a moisture content of 40 ppm, melted at 285° C., and extruded through a spinning nozzle having 36 orifices in a single array each having a diameter of 0.23 mm. The molten multifilaments thus extruded were passed through a retarded cooling zone 8 cm long at 60° C., and then rapidly cooled by blowing air at a speed of 0.35 m/min. Next, an aqueous emulsion finishing agent containing 10% by weight of the same lubricant as in Example 1 was allowed to adhere to the yarn in an amount of 1% by weight as the lubricant. The undrawn yarn was then wound at a speed of 1,600 m/min. The undrawn yarn was readily passed through a preheating roll at 55° C., and then a hot plate at 140° C. to effect drawing at a draw ratio of 3.2 and give a fiber of 75 d/36 f. The physical properties of the yarn thus obtained are shown in Table 2.

The peak value of the thermal stress of a spun yarn obtained by such a process in which spinning and drawing are not consecutively conducted becomes high.

COMPARATIVE EXAMPLE 9

The polymer obtained in Example 11 was dried according to a conventional manner to have a moisture content of 40 ppm, melted at 265° C., and extruded through a spinning nozzle having 36 orifices in a single array each having a diameter of 0.23 mm. The molten multifilaments thus extruded were passed through a retarded cooling zone 2 cm long at 60° C., and then rapidly cooled by blowing air at a speed of 0.35 m/min. An aqueous emulsion finishing agent containing 10% by weight of the same lubricant as in Example 1 was allowed to adhere to the yarn in an amount of 1% by weight as the lubricant. The undrawn yarn was then wound at a speed of 1,600 m/min. The undrawn yarn was readily passed through a preheating roll at 55° C., and then a hot plate at 190° C. to effect drawing at a draw ratio of 2.3 and give a fiber of 75 d/36 f. The physical properties of the yarn thus obtained are shown in Table 2. The peak value of the thermal stress of such a yarn tends to become high even when heat treated at high temperature.

COMPARATIVE EXAMPLE 10

A fiber was obtained in the same manner as in Comparative Example 9 except that the hot plate temperature and the draw ratio were set at 140° C. and 1.6, respectively. The physical properties of the yarn thus obtained are shown in Table 2. When the peak value of the thermal stress was allowed to fall within the scope of the present invention by lowering the draw ratio, the elongation fell outside the scope of the present invention. The unevenness in the thickness of the yarn thus obtained in the longitudinal direction became high.

COMPARATIVE EXAMPLE 11

The polymer in Example 11 was dried according to a conventional manner to have a moisture content of 40 ppm, melted at 265° C., and extruded through a spinning nozzle having 36 orifices arranged in a single row each having a diameter of 0.23 mm. The molten multifilaments thus extruded were passed through a retarded cooling zone 2 cm long at 60° C., and then rapidly cooled by blowing air at a speed of 0.35 m/min. An aqueous emulsion lubircant containing 10% by weight of the same finishing agent as in Example 1 was allowed to adhere to the yarn in an amount of 1% by weight as the lubricant. The yarn was then wound at a speed of 4,000 m/min on a tubular bobbin made of paper 7 mm thick having an outside diameter of 110 mm and a length of 350 mm with the winding width set at 300 mm. The physical properties of the fiber thus obtained are shown in Table 2. No tight winding was observed. Although the peak temperature of the thermal stress of the fiber thus obtained was in the scope of the present invention, the boil-off shrinkage exceeded the scope of the present invention.

EXAMPLE 14

The yarn in any of Examples 1, 3, 4, 6 and 12 was used as a warp and a weft, and a plain weave fabric was prepared. The fabric was conventionally scoured, and preset at 180° C. for 30 sec using a pin tenter. The fabric was then dyed at 98° C. for 60 minutes with a disperse dye in a bath containing 2% owf Kayalon Polyester Blue 3RSF (manufactured by Nippon Kayaku Co., Ltd.) and 0.5 g/l of a dispersant (trade name of Niccasan Salt 1200, manufactured by Nicca Chemical Co., Ltd.) with the pH adjusted to 6 with acetic acid. After dyeing, the fabric was washed with water, and finally set at 180° C. for 30 sec. All of the fabrics thus obtained had a soft feeling.

On the other hand, fabrics were similarly prepared using the fibers in Comparative Examples 7 to 9. The fabrics each showed a large shrinking width in the processing steps and a hard feeling due to shrinkage because the suitable setting and tentering conditions could not be determined. Furthermore, it can be concluded from the comparison of the color developing properties that those fabrics in which the fibers in Comparative Examples 7 to 9 had been used were only slightly dyed, and had a cheap look.

COMPARATIVE EXAMPLE 12

The fibers in Comparative Examples 10 and 11 were used, and fabrics were obtained in the same manner as in Example 14. The fabric obtained from the fiber in Comparative Example 10 showed significantly uneven dyeing. The fabric obtained from the fiber in Comparative Example 11 had a stiff feeling because it markedly shrank during scouring.

EXAMPLE 15

A warp-knitted fabric was prepared from the polyester fiber in Example 6 and a polyurethane-based stretch yarn (trade name of Roica, manufactured by Asahi Chemical Industry Co., Ltd.) having a size of 210 denier. In this case, the gauge was 28 G, and the loop length was 1,080 mm/480 courses for the polyester fiber and 112 mm/480 courses for the stretch yarn. The thread count was decided to be 90 courses/inch. Moreover, the blending ratio of the polyester fiber was set at 75.5%.

The non-treated fabric thus obtained was relaxation-scoured at 90° C. for 2 minutes and dry heat set at 160° C. for 1 minute. The fabric was then dyed at 95° C. for 60 minutes in a bath (bath ratio of 1:30) containing 8% owf of Dianix Black BG-FS (manufactured by Dye Star Japan K.K.) and 0.5 g/l of a dispersant (trade name of Niccasan Salt 1200, manufactured by Nicca Chemical Co., Ltd.) with the pH adjusted to 6 with acetic acid.

The fabric thus obtained showed a deep black color, and exhibited softness high stretchability, excellent touch touch with tenseness and resiliency.

EXAMPLE 16

A plain weave fabric was prepared by using as a warp a polyester fiber of 75 d/36 f which was obtained in the same manner as in Example 6, and a cuprammonium rayon as a weft having a size of 75 d/44 f. The plain weave fabric was conventionally scoured, and mercerized. The mercerization was conducted at room temperature by immersing the fabric in an aqueous solution containing 75% of sodium hydroxide. The fabric was then neutralized, washed with water, preset at 180° C. for 30 sec, and dyed by one step and one bath with a disperse dye and a reactive dye without using a carrier. Kayalon Polyester Blue BRSF (manufactured by Nippon Kayaku Co., Ltd.) was used as the disperse dye, and Drimarene Blue X-SGN (manufactured by Sandoz) was used as the reactive dye. An aqueous solution was prepared by using Disper TL (manufactured by Meisei Kagaku K.K.) in an amount of 1 g/l as a dispersant, adding 50 g/l of sodium sulfate and 15 g/l of sodium carbonate, and adjusting the pH to 11. A dyeing solution was prepared by adding the dyes to the aqueous solution. The fabric was dyed at 95° C. for 1 hour in a bath (bath ratio of 1:50) having a concentration of 2% owf. After dyeing, the fabric was soaped at 80° C. for 10 minutes in a bath (bath ratio of 1:50) containing 1 g/l of Granup P (manufactured by Sanyo Chemical Industries). After dyeing, the fabric was conventionally finished.

The fabric thus treated was uniformly dyed, and the hand touchness of the fabric had softness and dryness the qualities of which cannot be attained by a conventional fabric.

TABLE 1

Principal Conditions for Producing Fibers in Examples and Comparative Examples

| | Intrinsic viscosity [η] | Retarded cooling temp. ° C. | Roll temperature First ° C. | Roll temperature Second ° C. | Roll temperature Third ° C. | Peripheral speed of rolls First m/min | Peripheral speed of rolls Second m/min | Peripheral speed of rolls Third m/min |
|---|---|---|---|---|---|---|---|---|
| Ex. 1 | 1.0 | 100 | 60 | 133 | — | 2100 | 4300 | — |
| Ex. 2 | 1.0 | 100 | 55 | 130 | — | 2000 | 4000 | — |
| Ex. 3 | 1.0 | 50 | 50 | 140 | — | 1000 | 2210 | — |
| Ex. 4 | 1.0 | 100 | 57 | 138 | — | 2000 | 4000 | — |
| Ex. 5 | 0.9 | 30 | 50 | 140 | — | 1840 | 4600 | — |
| Ex. 6 | 0.70 | 60 | 50 | 140 | — | 1125 | 3600 | — |
| Ex. 7 | 0.70 | 60 | 55 | 140 | — | 1840 | 4600 | — |
| Ex. 8 | 0.70 | 60 | 55 | 150 | — | 1850 | 4960 | — |
| Ex. 9 | 0.70 | 60 | 55 | 100 | — | 1900 | 4960 | — |
| Ex. 10 | 0.70 | 60 | 55 | 120 | — | 1850 | 4960 | — |
| Ex. 11 | 0.9 | 30 | 50 | 140 | 20 | 1840 | 4600 | 4600 |
| Ex. 12 | 0.93 | 60 | 55 | 140 | 26 | 1150 | 3300 | 3000 |
| Ex. 13 | 1.00 | 70 | 60 | 145 | — | 1600 | 3520 | — |
| C.Ex. 1 | 1.00 | 100 | 60 | 133 | — | 2000 | 4000 | — |
| C.Ex. 2 | 1.00 | 60 | 25 | 140 | — | 1850 | 4960 | — |
| C.Ex. 3 | 1.00 | 60 | 90 | 140 | — | 1850 | 4960 | — |
| C.Ex. 4 | 1.00 | 60 | 55 | 80 | — | 1850 | 4960 | — |
| C.Ex. 5 | 1.00 | 60 | 55 | 140 | — | 4000 | 5200 | — |
| C.Ex. 6 | 1.00 | — | 60 | 140 | — | 2000 | 3800 | — |
| C.Ex. 7 | 0.93 | 110 | 55 | 140 | — | 2500 | 4300 | — |
| C.Ex. 8 | 1.00 | 60 | — | — | — | — | — | |
| C.Ex. 9 | 0.93 | 60 | — | — | — | — | — | — |
| C.Ex. 10 | 0.93 | 60 | — | — | — | — | — | — |
| C.Ex. 11 | 0.93 | 60 | — | — | — | — | — | — |

| | Winding speed m/min | Draw ratio | Relaxation ratio | Relaxation at third roll |
|---|---|---|---|---|
| Ex. 1 | 4180 | 2.05 | 0.97 | — |
| Ex. 2 | 3880 | 2.00 | 0.97 | — |
| Ex. 3 | 2130 | 2.21 | 0.96 | — |
| Ex. 4 | 3840 | 2.00 | 0.96 | — |
| Ex. 5 | 4300 | 2.50 | 0.93 | — |
| Ex. 6 | 3300 | 3.20 | 0.92 | — |
| Ex. 7 | 4300 | 2.50 | 0.93 | — |
| Ex. 8 | 4300 | 2.68 | 0.87 | — |
| Ex. 9 | 4300 | 2.61 | 0.87 | — |
| Ex. 10 | 4300 | 2.68 | 0.87 | — |
| Ex. 11 | 4300 | 2.50 | 0.93 | 1.0 |
| Ex. 12 | 2890 | 2.87 | 0.88 | 0.91 |
| Ex. 13 | 3100 | 2.20 | 0.88 | — |
| C.Ex. 1 | 4000 | 2.00 | 1.00 | — |
| C.Ex. 2 | 4300 | 2.68 | 0.87 | — |
| C.Ex. 3 | 4300 | 2.68 | 0.87 | — |
| C.Ex. 4 | 4700 | 2.68 | 0.95 | — |
| C.Ex. 5 | 4800 | 1.30 | 0.92 | — |
| C.Ex. 6 | 3850 | 1.90 | 1.01 | — |
| C.Ex. 7 | 4300 | 1.72 | 1.00 | — |
| C.Ex. 8 | — | — | — | — |
| C.Ex. 9 | — | — | — | — |
| C.Ex. 10 | — | — | — | — |
| C.Ex. 11 | 4000 | — | — | — |

Note: Relaxation ratio: winding speed/peripheral speed of second roll
Relaxation ratio at third roll: peripheral speed of third roll/peripheral speed of second roll

TABLE 2

Physical Properties and Bulging rate of Fibers in Examples and Comparative Examples

| | Winding tension g/d | Tenacity g/d | Elongation % | Elastic modulus g/d | Elastic recovery % | Boil-off shrinkage % |
|---|---|---|---|---|---|---|
| Ex. 1 | 0.37 | 4.5 | 25 | 23 | 88 | 10 |
| Ex. 2 | 0.35 | 4.3 | 25 | 24 | 90 | 11 |
| Ex. 3 | 0.23 | 3.6 | 35 | 23 | 85 | 9 |
| Ex. 4 | 0.36 | 4.2 | 27 | 22 | 88 | 13 |
| Ex. 5 | 0.30 | 4.2 | 31 | 24 | 89 | 13 |
| Ex. 6 | 0.29 | 3.6 | 39 | 18 | 77 | 12 |
| Ex. 7 | 0.38 | 3.9 | 36 | 20 | 81 | 12 |
| Ex. 8 | 0.15 | 4.0 | 40 | 20 | 77 | 7.2 |
| Ex. 9 | 0.16 | 4.0 | 40 | 21 | 71 | 12 |
| Ex. 10 | 0.18 | 4.3 | 42 | 21 | 78 | 10 |
| Ex. 11 | 0.31 | 4.0 | 35 | 21 | 85 | 13 |
| Ex. 12 | 0.09 | 4.1 | 43 | 21 | 78 | 11 |
| Ex. 13 | 0.10 | 3.2 | 35 | 22 | 71 | 11 |
| C.Ex. 1 | 0.56 | 4.0 | 25 | 23 | 84 | 15 |
| C.Ex. 2 | | Yarn could not be wound. | | | | — |
| C.Ex. 3 | | Yarn could not be wound. | | | | |
| C.Ex. 4 | 0.50 | 3.8 | 42 | 21 | 72 | 17 |
| C.Ex. 5 | | Yarn could not be wound. | | | | — |
| C.Ex. 6 | 0.49 | 3.2 | 32 | 24 | 80 | 17 |
| C.Ex. 7 | 0.56 | 3.83 | 36 | 18 | 81 | 13 |
| C.Ex. 8 | — | 4.4 | 23 | 27 | 88 | 14 |
| C.Ex. 9 | — | 4.0 | 37 | 28 | 92 | 12 |
| C.Ex. 10 | — | 3.3 | 65 | 24 | 65 | 11 |
| C.Ex. 11 | — | 3.1 | 61 | 20 | 55 | 24 |

| | Thermal stress | | | | | | |
|---|---|---|---|---|---|---|---|
| | Peak value g/d | Peak temp. ° C. | 100° C. value g/d | S/T | Q/R | $T_{max}$ ° C. | Bulging rate % |
| Ex. 1 | 0.31 | 160 | 0.24 | 0.77 | 0.26 | 111 | 9 |
| Ex. 2 | 0.28 | 155 | 0.22 | 0.79 | 0.27 | 108 | 8 |
| Ex. 3 | 0.22 | 165 | 0.14 | 0.64 | 0.27 | 107 | 6 |
| Ex. 4 | 0.18 | 160 | 0.13 | 0.72 | 0.25 | 107 | 8 |
| Ex. 5 | 0.31 | 156 | 0.22 | 0.71 | 0.27 | 109 | 6 |
| Ex. 6 | 0.28 | 155 | 0.18 | 0.64 | 0.23 | 112 | 7 |
| Ex. 7 | 0.33 | 156 | 0.25 | 0.76 | 0.25 | 113 | 7 |
| Ex. 8 | 0.17 | 193 | 0.05 | 0.29 | 0.26 | 113 | 5 |
| Ex. 9 | 0.28 | 158 | 0.24 | 0.86 | 0.30 | 110 | 3 |
| Ex. 10 | 0.25 | 173 | 0.17 | 0.68 | 0.27 | 111 | 2 |
| Ex. 11 | 0.34 | 155 | 0.24 | 0.71 | 0.25 | 109 | 2 |
| Ex. 12 | 0.25 | 173 | 0.15 | 0.60 | 0.27 | 108 | 0.5 |
| Ex. 13 | 0.23 | 161 | 0.15 | 0.65 | 0.31 | 102 | — |
| C.Ex. 1 | 0.38 | 157 | 0.33 | 0.87 | 0.27 | 112 | 15 |
| C.Ex. 2 | — | — | — | — | — | — | |
| C.Ex. 3 | — | — | — | — | — | — | |
| C.Ex. 4 | 0.36 | 134 | 0.33 | 0.92 | 0.29 | 109 | — |
| C.Ex. 5 | — | — | — | — | — | — | |
| C.Ex. 6 | 0.36 | 156 | 0.32 | 0.89 | 0.30 | 113 | — |
| C.Ex. 7 | 0.36 | 172 | 0.26 | 0.72 | 0.22 | 109 | 16 |
| C.Ex. 8 | 0.46 | 170 | 0.43 | 0.93 | 0.31 | 114 | — |
| C.Ex. 9 | 0.36 | 178 | 0.31 | 0.86 | 0.30 | 107 | — |
| C.Ex. 10 | 0.23 | 140 | 0.2 | 0.87 | 0.37 | 106 | — |
| C.Ex. 11 | 0.12 | 60 | 0.08 | 0.67 | 0.36 | 99 | — |

Note: Thermal stress 100° C. value: thermal stress value at 100° C.
S/T: thermal stress value at 100° C. (S)/peak value of thermal stress (T)
Q/R: elastic modulus (Ω)/elastic recovery (R)

INDUSTRIAL APPLICABILITY

The polyester fiber of the present invention is one which does not excessively shrink with heat in converting processings such as scouring, dyeing and heat setting of a woven or knitted fabric prepared therefrom and which, as a result, does not give a hard woven or knitted fabric, and which manifests the soft feeling expected from the low elastic modulus characteristic of the poly(trimethylene terephthalate) fiber, and excellent color developing properties. Accordingly, the polyester fiber of the present invention is a fiber material appropriate to textile products for articles of clothing such as innerwear, outerwear, sportswear, lining cloths, legwear, swimwear and the like. Moreover, the polyester of the invention is also suited to a fiber material for industrial or soft furnishing such as carpets, interling cloths, piles, flocked fabric, strings for racket and nonwoven fabrics.

Furthermore, when the PTT-based polyester fiber of the present invention is produced by a process in which spinning and drawing are done consecutively, a good shaped package of high quality in the form of cheese in which a large amount of yarn is less-tightly wound can be manufactured.

What is claimed is:

1. A polyester fiber comprising 90% or more by weight of a poly(trimethylene terephthalate), and showing a peak value of a thermal stress of 0.1 to 0.35 g/d, a boil-off shrinkage of 5 to 16%, a tenacity of 3 g/d or more, an elongation of 20 to 60%, a relationship between an elastic modulus Q (g/d) and an elastic recovery R (%) satisfying the formula (1), and a peak temperature of a loss tangent of 90 to 120° C.:

$$0.18 \leqq Q/R \leqq 0.45 \quad (1).$$

2. The polyester fiber according to claim 1, wherein the peak value of a thermal stress is from 0.1 to 0.25 g/d, and the elongation is from 35 to 50%.

3. A cheese-like package which is formed by winding a fiber of claim 1 and which shows a bulging rate of 10% or less.

4. The cheese-like package of claim 3, wherein the peak value of the thermal stress is from 0.1 to 0.25 g/d, and the elongation is from 35 to 50%.

5. A polyester fiber of claim 1 having a peak temperature of a thermal stress of 100 to 200° C., a peak value of a thermal stress of 0.1 to 0.35 g/d, and a relationship between the peak value of a thermal stress and a thermal stress at 100° C. satisfying the formula (2):

$$0.2 \leqq S/T \leqq 0.85 \quad (2)$$

wherein T is the peak value (g/d) of a thermal stress, and S is a thermal stress; (g/d) at 100° C.

6. The polyester fiber of claim 5, wherein the peak value of the thermal stress is from 0.1 to 0.25 g/d, and the elongation is from 35 to 50%.

7. A cheese-like package which is formed by winding a fiber of claim 5 and which shows a bulging rate of 10% or less.

8. The cheese-like package of claim 7, wherein the peak value of the thermal stress is from 0.1 to 0.25 g/d, and the elongation is from 35 to 50%.

9. A fabric made partly or entirely of a polyester fiber of claim 1.

10. A fabric made partly or entirely of a polyester fiber of claim 2.

11. A fabric made partly or entirely of a polyester fiber of claim 5.

12. A fabric made partly or entirely of a polyester fiber of claim 6.

* * * * *

UNITED STATES PATENT AND TRADEMARK OFFICE

CERTIFICATE OF CORRECTION

PATENT NO. : 6,284,370 B1
DATED : September 4, 2001
INVENTOR(S) : Katsuhiro Fujimoto It is certified that error appears in the above-identified patent and that said Letters Patent is hereby corrected as shown below:

Title page,
Item [30], Foreign Application Priority Data, delete "Jan. 29, 1998 (JP) 10-30391"; and delete "Apr. 23, 1998 (JP) 10-128118".

Column 26,
Line 7, "stress; (gld)" should read -- stress (gld) --.

Signed and Sealed this

Eighteenth Day of March, 2003

JAMES E. ROGAN
*Director of the United States Patent and Trademark Office*